US011518580B2

(12) United States Patent
Johnson

(10) Patent No.: US 11,518,580 B2
(45) Date of Patent: Dec. 6, 2022

(54) ASEPTIC SCREW-CAP ASSEMBLY

(71) Applicant: Liqui-Box Corporation, Richmond, VA (US)

(72) Inventor: James W. Johnson, Delaware, OH (US)

(73) Assignee: Liqui-Box Corporation, Richmond, VA (US)

( * ) Notice: Subject to any disclaimer, the term of this patent is extended or adjusted under 35 U.S.C. 154(b) by 0 days.

(21) Appl. No.: 17/161,052

(22) Filed: Jan. 28, 2021

(65) Prior Publication Data

US 2021/0147120 A1 May 20, 2021

Related U.S. Application Data

(63) Continuation of application No. 16/127,698, filed on Sep. 11, 2018, now Pat. No. 10,934,057.

(60) Provisional application No. 62/556,908, filed on Sep. 11, 2017.

(51) Int. Cl.

| | |
|---|---|
| ***B65D 33/24*** | (2006.01) |
| ***B65B 7/16*** | (2006.01) |
| ***B65D 41/34*** | (2006.01) |
| ***B65D 51/20*** | (2006.01) |
| ***B65D 75/58*** | (2006.01) |
| ***B65D 55/02*** | (2006.01) |
| ***B65D 77/06*** | (2006.01) |
| ***B65D 39/00*** | (2006.01) |
| ***B65B 55/02*** | (2006.01) |
| *B65B 3/04* | (2006.01) |

(52) U.S. Cl.

CPC ..... *B65D 33/24* (2013.01); *B65B 7/168* (2013.01); *B65B 55/025* (2013.01); *B65D 39/0023* (2013.01); *B65D 41/3409* (2013.01); *B65D 51/20* (2013.01); *B65D 75/5883* (2013.01); *B65D 77/065* (2013.01); *B65B 3/045* (2013.01); *B65B 55/022* (2013.01); *B65D 2251/0015* (2013.01)

(58) Field of Classification Search

CPC ..... B65B 55/022; B65B 55/025; B65B 7/168; B65B 3/045; B65D 75/5883; B65D 77/065; B65D 51/20; B65D 39/0023; B65D 33/24; B65D 2251/0015; B65D 41/3409

See application file for complete search history.

(56) References Cited

U.S. PATENT DOCUMENTS 2,248,873 A * 7/1941 Hummel ..... A24F 19/145 131/236
2,746,632 A 5/1956 Bramming
6,644,510 B2 11/2003 Kawolics et al.
(Continued)

FOREIGN PATENT DOCUMENTS

CN 201350013 Y 11/2009
EP 1245499 A1 10/2002
(Continued)

*Primary Examiner* — Andrew M Tecco
*Assistant Examiner* — Nicholas E Igbokwe
(74) *Attorney, Agent, or Firm* — McAndrews, Held & Malloy, Ltd.

(57) ABSTRACT

Disclosed herein is a fluid transfer assembly for dispensing flowable material from a container, the fluid transfer assembly having a spout, a screw cap body, and an aseptic plug, wherein the aseptic plug is configured to form an aseptic seal with the screw cap body.

7 Claims, 5 Drawing Sheets

(56) References Cited

U.S. PATENT DOCUMENTS

| | | | | |
|---|---|---|---|---|
| 6,871,764 | B2 | 3/2005 | Stoneberg et al. | |
| 10,086,980 | B2 | 10/2018 | Isogai | |
| 2005/0045654 | A1 | 3/2005 | Kuge et al. | |
| 2007/0012644 | A1 | 1/2007 | Uytterhaeghe et al. | |
| 2009/0139883 | A1* | 6/2009 | Py | B65D 47/265 206/219 |
| 2011/0155758 | A1 | 6/2011 | Johnson | |
| 2011/0233211 | A1 | 9/2011 | McClellan | |
| 2014/0209643 | A1 | 7/2014 | Smith et al. | |
| 2015/0001261 | A1* | 1/2015 | Johnson | B65D 47/283 53/469 |
| 2015/0274331 | A1* | 10/2015 | Zinn | B65B 3/04 141/2 |
| 2016/0200496 | A1* | 7/2016 | Nahir | B65D 77/068 222/153.09 |
| 2016/0264319 | A1 | 9/2016 | Johnson | |
| 2019/0119024 | A1 | 4/2019 | Tamarindo | |

FOREIGN PATENT DOCUMENTS

| | | | |
|---|---|---|---|
| JP | 10-157758 | A | 6/1998 |
| JP | 2002-104450 | A | 4/2002 |

* cited by examiner

ASEPTIC SCREW-CAP ASSEMBLY

CROSS REFERENCE TO RELATED APPLICATIONS

This application claims the benefit of U.S. Provisional Application No. 62/556,908, filed Sep. 11, 2017, the entirety of which is incorporated herein for any and all purposes.

TECHNICAL FIELD

This invention relates to a fluid transfer assembly for use with flexible containers for flowable materials, such as liquids.

BACKGROUND

Flexible polymeric containers are extensively used throughout the food service industry for storing and dispensing soft drink syrups and other such beverages, as well as wine, dairy products, enteral feeding solutions, fruit juices, tea and coffee concentrates, puddings, cheese sauces, and many other flowable materials, including those that must be filled aseptically.

The flexible polymeric containers may have inlets and/or spouts for filling and dispensing the container contents. The containers are also often placed within a corrugated paper box. Such packaging systems are commonly referred to as "bag-in-box" systems wherein the spout extends through an opening in the box to dispense the contents. Bag-in-box packaging systems are often used in restaurants, institutional food service centers, and convenience stores to facilitate service of liquid food products such as syrups, toppings, condiments, beverages and dairy products. These containers typically have a capacity of 1 to 6 gallons.

Fluid transfer assemblies are used to move fluid into the containers. The fluid transfer assemblies are also used to dispense the fluid from the containers. Existing fluid transfer assemblies lack suitable methods of creating and maintaining reusable aseptic seals.

SUMMARY

According to an embodiment of the present disclosure, a fluid transfer assembly for dispensing flowable material from a container includes a spout, a screw cap body, and an aseptic plug. The aseptic plug is configured to form an aseptic seal with the screw cap body.

According to another embodiment, a method of introducing fluid into a container through a fluid transfer assembly includes the steps of moving fluid into the container through a spout fixedly attached to the container and moving an aseptic plug into the fluid transfer assembly, such that a fluid-tight seal is formed between the plug and the screw cap body.

According to yet another embodiment, a method of dispensing fluid using a fluid transfer assembly includes the steps of removing an aseptic plug from the fluid transfer assembly such that a seal between the aseptic plug and the fluid transfer assembly is broken and such that fluid can move from a container through and out of the fluid transfer assembly, connecting a dispenser to the fluid transfer assembly such that the fluid moves through the fluid dispenser, and dispensing the fluid.

BRIEF DESCRIPTION OF THE DRAWINGS

The present application is further understood when read in conjunction with the appended drawings. For the purpose of illustrating the subject matter, there are shown in the drawings exemplary embodiments of the subject matter; however, the presently disclosed subject matter is not limited to the specific methods, devices, and systems disclosed. Furthermore, the drawings are not necessarily drawn to scale. In the drawings.

DETAILED DESCRIPTION OF ILLUSTRATIVE EMBODIMENTS

Figure 1:
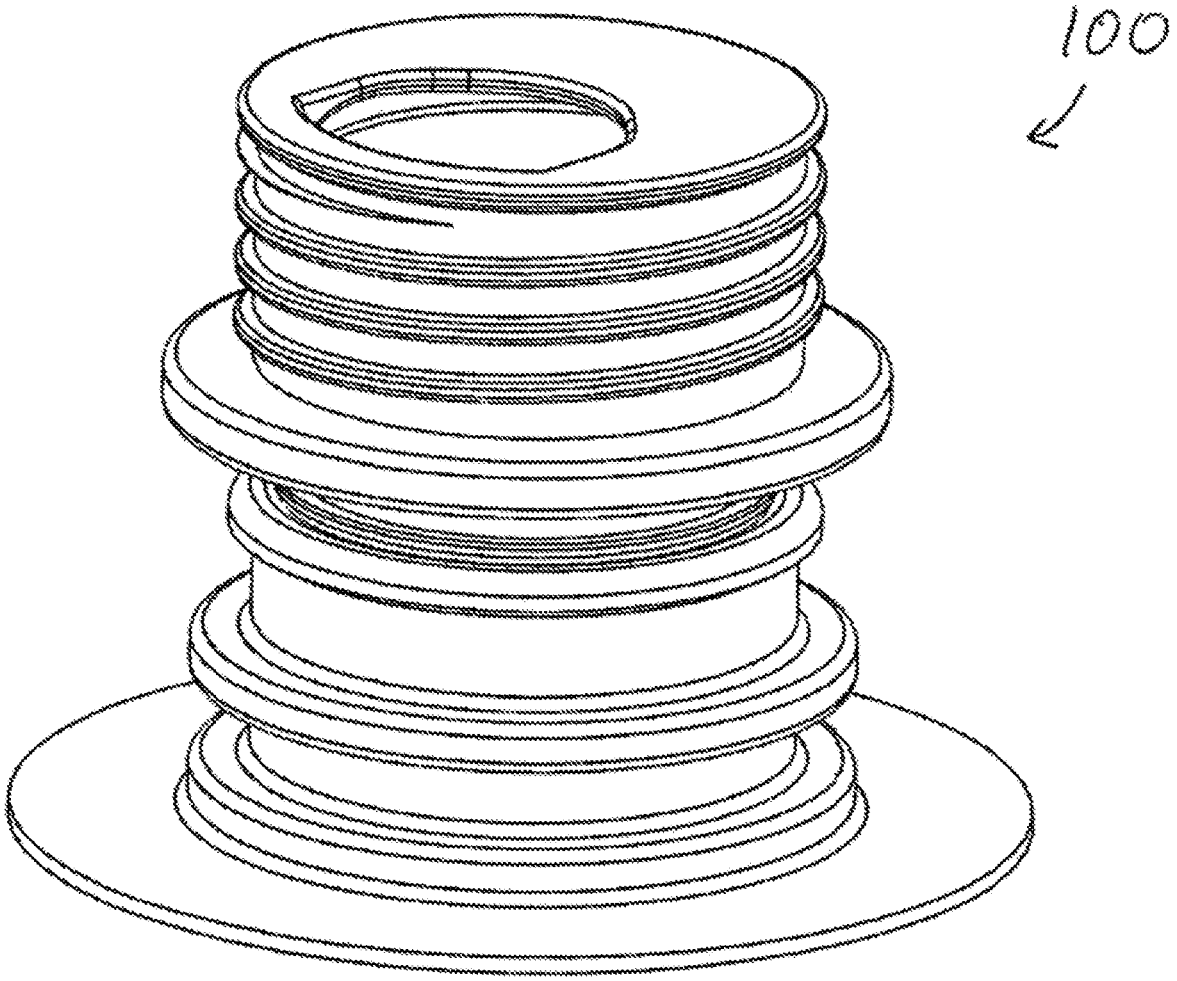
FIG. 1 illustrates an isometric view of an aseptic screw-cap assembly according to an embodiment.
Figure 2:
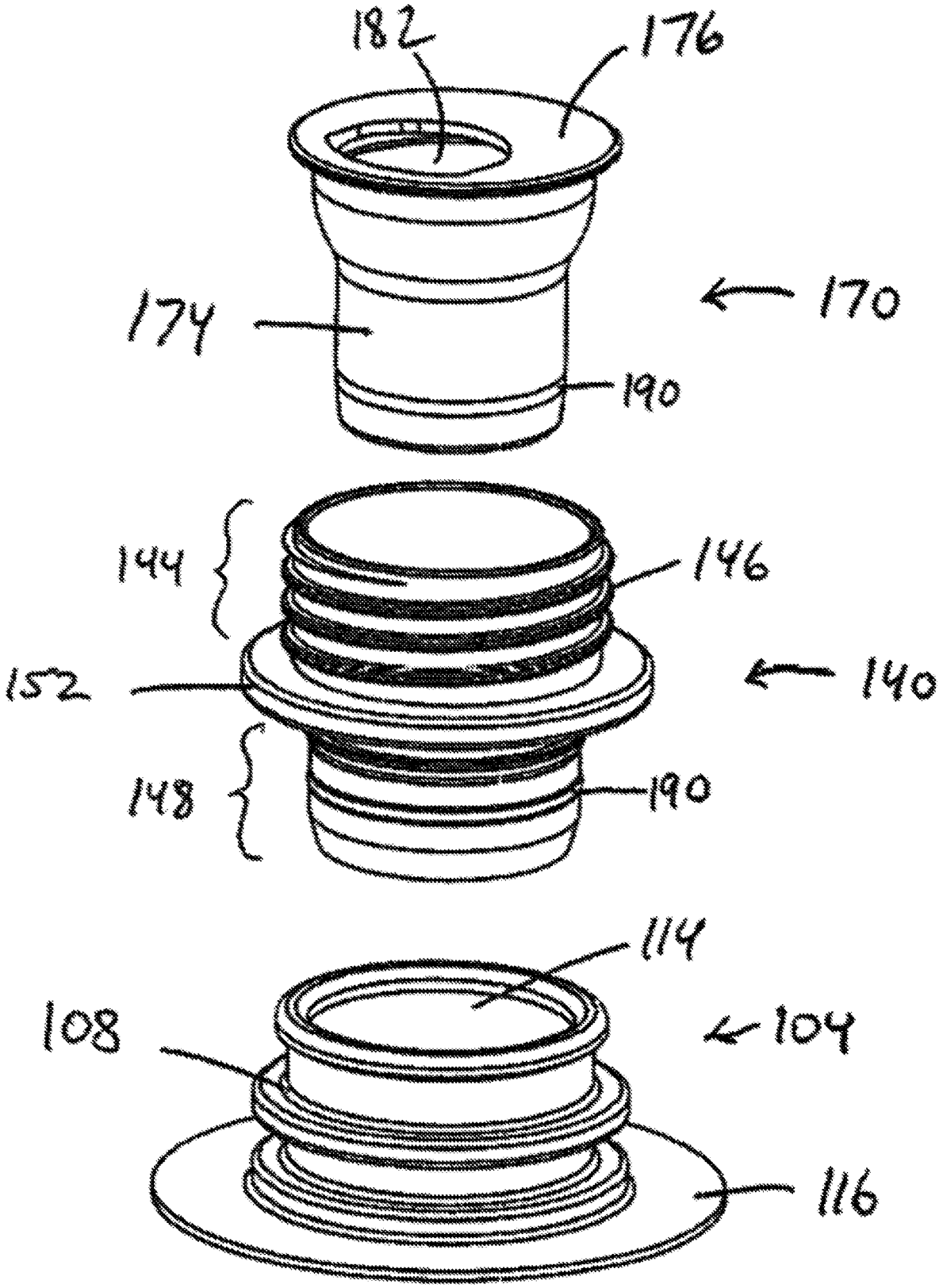
FIG. 2 illustrates an exploded isometric view of the aseptic screw-cap assembly of FIG. 1.
Figure 3:
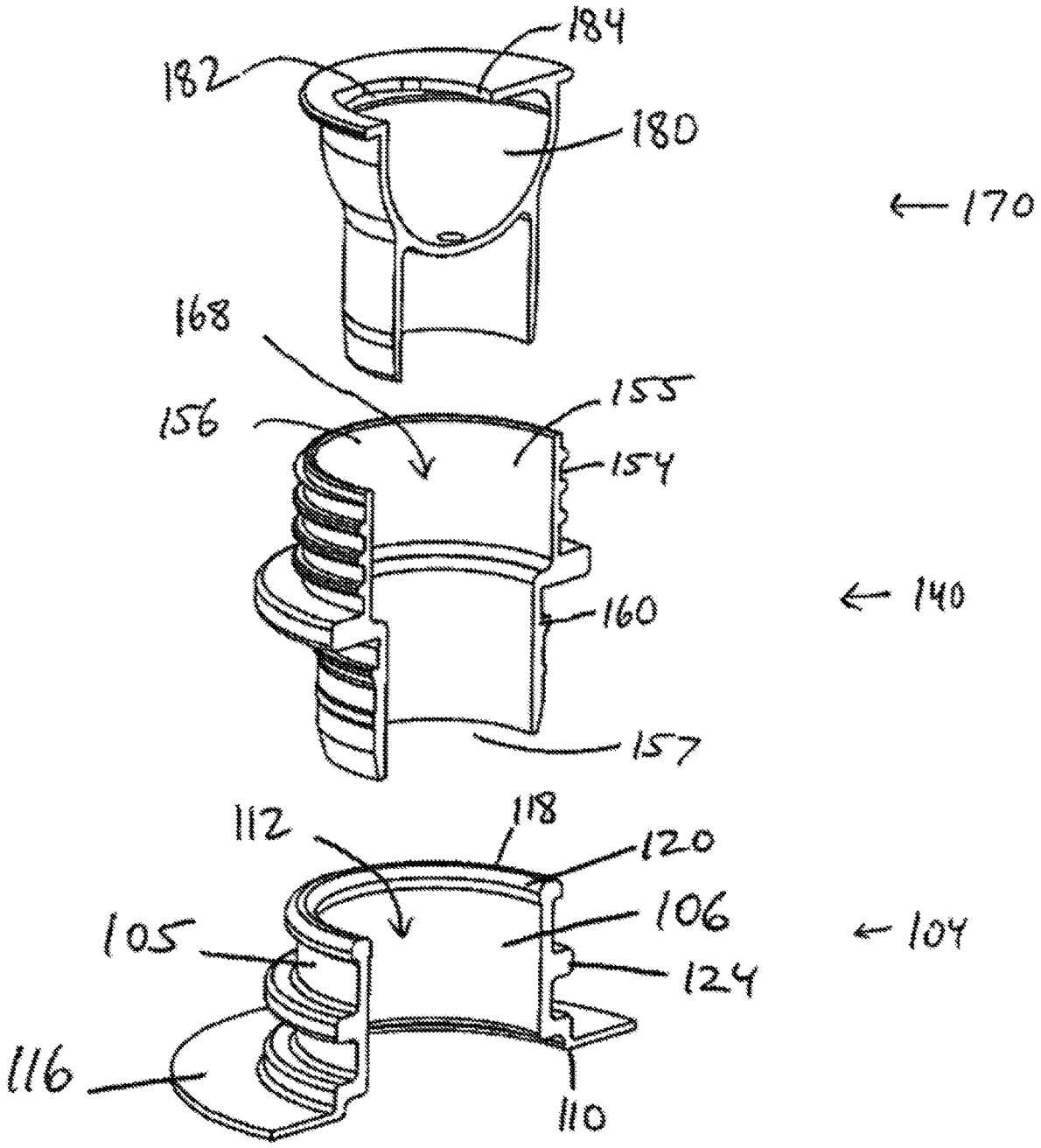
FIG. 3 illustrates an exploded cross-sectional view of the aseptic screw-cap assembly of FIGS. 1 and 2.

Aspects of the disclosure will now be described in detail with reference to the drawings, wherein like reference numbers refer to like elements throughout, unless specified otherwise. Certain terminology is used in the following description for convenience only and is not limiting.

The term "plurality," as used herein, means more than one. The singular forms "a," "an," and "the" include the plural reference, and reference to a particular numerical value includes at least that particular value, unless the context clearly indicates otherwise. Thus, for example, a reference to "a material" is a reference to at least one of such materials and equivalents thereof known to those skilled in the art, and so forth.

The transitional terms "comprising," "consisting essentially of," and "consisting" are intended to connote their generally in accepted meanings in the patent vernacular; that is, (i) "comprising," which is synonymous with "including," "containing," or "characterized by," is inclusive or open-ended and does not exclude additional, unrecited elements or method steps; (ii) "consisting of" excludes any element, step, or ingredient not specified in the claim; and (iii) "consisting essentially of" limits the scope of a claim to the specified materials or steps "and those that do not materially affect the basic and novel characteristic(s" of the claimed invention. Embodiments described in terms of the phrase "comprising" (or its equivalents), also provide, as embodiments, those which are independently described in terms of "consisting of" and "consisting essentially of."

When values are expressed as approximations by use of the antecedent "about," it will be understood that the particular value forms another embodiment. In general, use of the term "about" indicates approximations that can vary depending on the desired properties sought to be obtained by the disclosed subject matter and is to be interpreted in the specific context in which it is used, based on its function, and the person skilled in the art will be able to interpret it as such. In some cases, the number of significant figures used for a particular value may be one non-limiting method of determining the extent of the word "about." In other cases, the gradations used in a series of values may be used to determine the intended range available to the term "about" for each value. Where present, all ranges are inclusive and combinable. That is, reference to values stated in ranges includes each and every value within that range.

When a list is presented, unless stated otherwise, it is to be understood that each individual element of that list, and every combination of that list, is a separate embodiment. For example, a list of embodiments presented as "A, B, or C" is to be interpreted as including the embodiments, "A," "B," "C," "A or B," "A or C," "B or C," or "A, B, or C."

Throughout this specification, words are to be afforded their normal meaning as would be understood by those skilled in the relevant art. However, so as to avoid misunderstanding, the meanings of certain terms will be specifically defined or clarified.

In a liquid dispensing apparatus configured to dispense liquid contained within a collapsible container, for example a "bag-in-box" concept, it is often difficult to open a sealed spout assembly for use without damaging the spout or the plug. Additionally, there is often difficulty in re-sealing the spout assembly for later use while maintain aseptic properties. In the present disclosure, an aseptic screw-cap assembly includes a spout through which a container can be filled, a screw cap body that attached to the spout, and an aseptic plug that engages with the screw cap body to seal the opening therethrough.

Referring to FIGS. 1-5, the aseptic screw-cap assembly 100 includes a spout 104, a screw cap body 140, and an aseptic plug 170. The aseptic screw-cap assembly 100 is attached to a container (not shown) for holding a liquid via the spout 104. The spout 104 includes a spout body 108 that includes an outer surface 105 and an inner surface 106 that defines a passage 112 extending through the spout body 108. The spout body 108 is generally cylindrical, but could be another suitable shape. A flange 116 is disposed on the spout body 108. The flange 116 is sealed to the container configured to hold a liquid to be stored or dispensed. As shown in FIGS. 1-5, the flange 116 may be disposed at a first end 110 of the spout body 108, typically at the base of the spout 104. The spout 104 may further include an annular lip 120 disposed on a second end 118 of the spout body 108, the second end 118 being opposite the first end 110. The passage 112 includes an opening 114 at the second end 118 of the spout 104.

The spout 104 may further include an annular ridge 124 extending at least partially around the spout body 108 between the first end 110 and the second end 118. The annular lip 120 includes an annular ridge top surface 125 and an annular ridge bottom surface 126 opposite the annular ridge top surface 125. In the exemplary embodiment shown in FIGS. 1-5, the annular lip 120 extends around the entire circumference of the spout body 108. The inner surface 106 that defines the passage 112 may be substantially smooth, or alternatively, the inner surface 106 may include one or more sealing elements 190 configured to provide an aseptic and fluid-tight seal between the inner surface 106 and a component inserted into the passage 112. Sealing elements 190 may include sealing beads, stop ridges, gaskets, or other suitable structures configured to provide a fluid-tight seal between two or more adjacent components. In alternative embodiments, the inner surface 106 may include internal threads (not shown) configured to engage with complimentary threads of another component of the assembly.

The passage 112 of the spout 104 is configured to receive within it a screw cap body 140. The screw cap body 140 includes a top portion 144, a bottom portion 148, and an annular flange 152 between the top portion 144 and the bottom portion 148. In some embodiments, the bottom portion 148 may include external threading (not shown) configured to engage with the internal threads of the passage 112 of the spout 104. In such embodiments, the screw cap body 140 may be threadably inserted into the passage 112 of the spout. Alternatively, the bottom portion 148 may include one or more sealing elements 190 configured to interact with the inner surface 106 of the spout 104, with the sealing elements 190 disposed on the inner surface 106, or with both. In such embodiments, the screw cap body 140 may be inserted into the passage 112 of the spout 104 such that it is retained within the passage 112 via push-fit friction interaction between contacting surfaces, for example the outer surface 154 of the screw cap body 140 and the inner surface 106 of the spout 104. As shown in the illustrative embodiments of FIGS. 1-5, the screw cap body 140 can be inserted into the passage 112 of the spout 104 until the annular flange 152 on the screw cap body 140 contacts the annular lip 120 of the spout 104.

In some embodiments, the top portion 144 may include external threads 146 configured to engage with corresponding threads on a separate component. The external threads 146 may connect the screw cap body 140 to another component of the assembly or with an external tool or dispenser. It will be understood that various dispensers, tools, and connectors may be used in the field, and that this disclosure is not limited to any particular connectors.

In some embodiments, the screw cap body 140 may include one or more locking elements 160. The locking element 160 may be a flange configured to engage with a corresponding locking element on another component of the assembly. It will be understood that various locking elements may be used, and that this disclosure is not limited to the particular locking element described. In some embodiments, the locking element 160 may include an inclined surface 162 configured to slidably receive a corresponding locking component and a locking surface 164 configured to retain the corresponding locking component once it is moved beyond a threshold locking position. In some embodiments, the locking element 160 may be configured to engage with a corresponding locking component on the spout 104. Referring to FIGS. 1-5, the locking element 160 is configured to engage with the annular lip 120 of the spout 104. The annular ridge top surface 125 is configured to slidably contact the inclined surface 162 of the locking element. When the annular lip 120 passes over the inclined surface 162, the annular ridge bottom surface 126 is configured to contact the locking surface 164 of the locking element 160. In this position, the screw cap body 140 is fixedly attached to the spout 104 and is not intended to be removed without excessive force and/or damage to either of the components.

Figure 4:
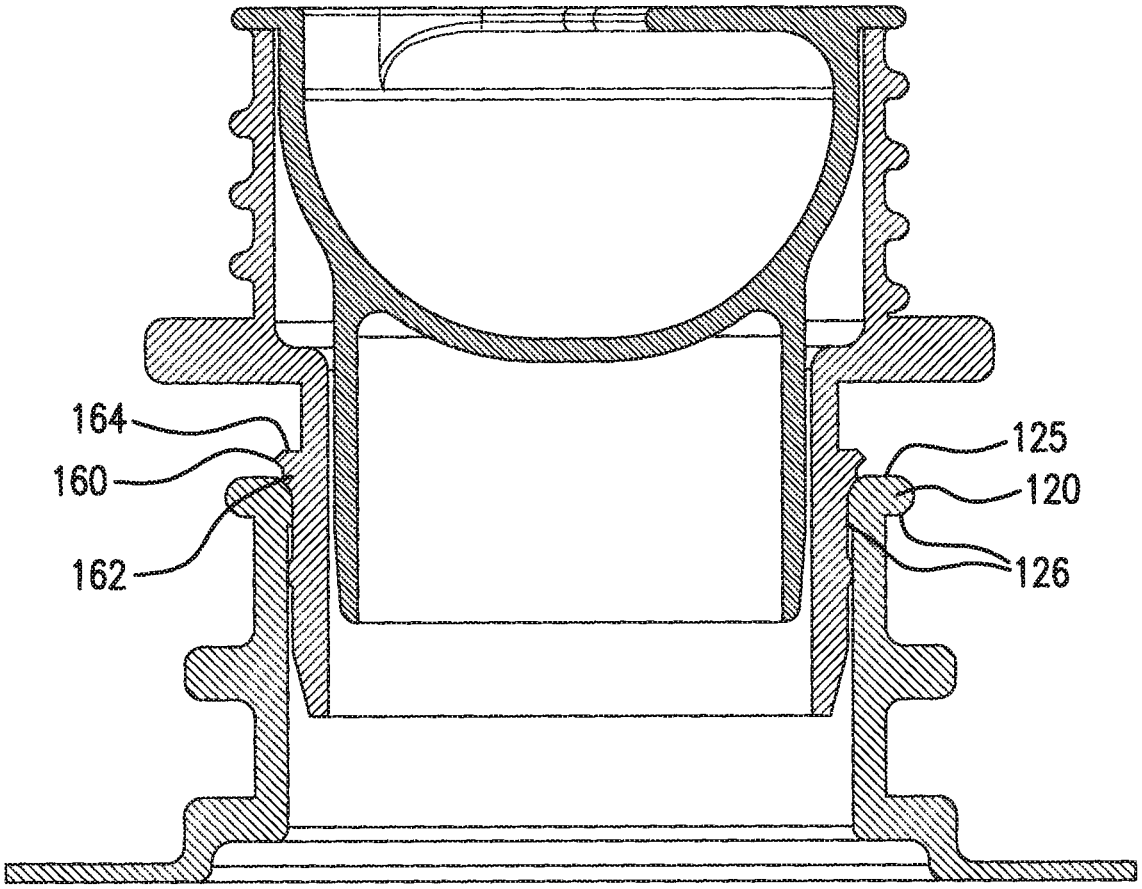
FIG. 4 illustrates a cross-sectional view of an aseptic screw-cap assembly.
Figure 5:
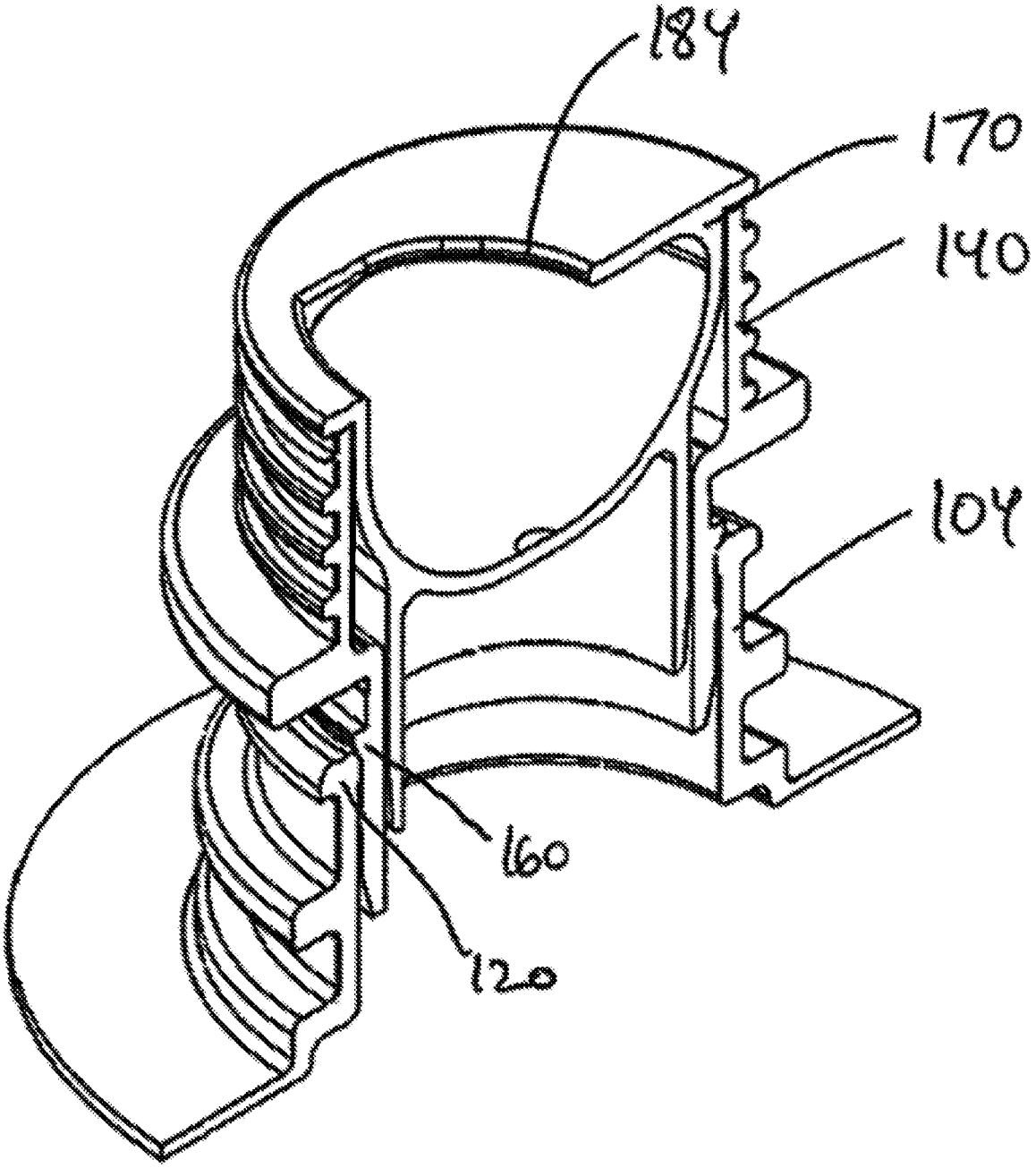
FIG. 5 illustrates another cross-sectional view of an aseptic screw-cap assembly.

In some embodiments, the screw cap body 140 may include three configurations. In a removed configuration, the screw cap body 140 is not within the passage 112. The removed configuration can be used when fluid is introduced into the container through the spout 104, for example during an initial filling phase. In an unlocked configuration, the screw cap body 140 is at least partially within the passage 112 of the spout 104, but it is not inserted the maximum allowed distance. As shown in FIGS. 4 and 5, in the unlocked configuration, the bottom portion 148 of the screw cap body 140 is partially inserted into the passage 112, but the annular flange 152 does not contact the annular lip 120 of the spout. The locking element 160 is not fixedly engaged with the annular lip 120 in the unlocked configuration. The unlocked configuration may be useful during transportation, storage, and preparation of the assembly, the container, or both. While in the unlocked configuration, the screw cap body 140 is easily removable from the spout 104. This is advantageous for easy access to the spout 104 and/or the fluid container to which the spout 104 is attached.

In a locked configuration, the screw cap body 140 is at least partially within the passage 112 of the spout 104. The screw cap body 140 in this configuration is inserted to the maximum permitted distance. In the locked configuration, the bottom portion 148 of the screw cap body 140 is inserted into the passage 112, and the annular flange 152 contacts the annular lip 120 of the spout. The annular flange 152 acts as a physical stop to prevent further insertion of the screw cap body 140 into the passage 112. In the locked configuration, the locking element 160 is engaged with the annular lip 120 such that the locking surface 164 contacts the annular ridge bottom surface 126. In the locked configuration, the screw cap body 140 is designed to remain inserted into the spout 104 and is not designed to be easily removed without using excessive force and/or damaging the one or more components. When in the locked configuration, an aseptic fluid-tight seal may exist between the screw cap body 140 and the spout 104.

The screw cap body 140 further includes a passage 168 extending therethrough. The passage 168 is defined by the inner surface 155 and includes a top opening 156 and a bottom opening 157. The passage 168 of the screw cap body 140 may be configured to fluidly communicate with the passage 112 of the spout 104 when the screw cap body 140 is inserted into the spout 104.

The passage 168 of the screw cap body 140 is configured to receive within it an aseptic plug 170. The aseptic plug 170 includes a plug body 174 and a top surface 176. The plug body 174 is configured to engage with the inner surface 155 of the screw cap body 140 in a push-fit manner such that an aseptic fluid-tight seal exists between the plug body 174 and the inner surface 155 when the aseptic plug 170 is fully inserted into the passage 168 of the screw cap body 140. The aseptic plug 170 may include one or more sealing elements 190 thereon, which are configured to engage with corresponding sealing elements on the inner surface 155 of the screw cap body 140, with the inner surface 155 itself, or with both to form an aseptic fluid-tight seal.

The aseptic plug 170 further includes a chamber 180 inside the aseptic plug 170. The chamber 180 has an opening 182. In some embodiments, the opening 182 may be defined by the top surface 176. The top surface 176 may further define a ledge 184 that further defines the chamber 180. The opening 182 may be dimensioned such that a tool or a user's finger may be inserted into the chamber 180 through the opening 182 to contact the ledge 184. The ledge 184 is configured to withstand a force applied to it from within the chamber 180 such that the aseptic plug 170 is dislodged and removed from within the passage 168 of the screw cap body 140. The ledge 184 may also be configured to withstand a force applied to the top surface 176 such that the aseptic plug 170 is inserted into the passage 168 of the screw cap body 140 to a desired distance and with sufficient force to form an aseptic fluid-tight seal between the aseptic plug 170 and the screw cap body 140.

Using an aseptic plug as described above may be advantageous because the plug may be reused multiple times. For example, when a sufficient amount of fluid has been dispensed using the assembly, the user may re-insert the aseptic plug back into the screw cap body and re-establish the seal. This prevents leaking of the fluid out of the container, unwanted debris or contaminants entering the container, and prolonged exposure to environmental conditions that may adversely affect the contents of the container and/or decrease the shelf life of the product inside. The plug further offers an advantage of being structurally rigid enough to withstand being removed from the assembly and being introduced into the assembly multiple times. This overcomes several problems with existing solutions. Some aseptic closure mechanisms available in the market are not reusable. Furthermore, many existing aseptic closure mechanisms are fragile and often break or degrade when they are used. Unexpected or unnoticed damage to the aseptic closure mechanism may negatively affect the integrity of the aseptic fluid-tight seal.

Embodiments of the aseptic screw-cap assemblies as described herein offer improved methods of introducing and/or preparing fluid for storage, transportation, and/or dispensing. A method of introducing fluid into a container using an aseptic screw-cap assembly may include the step of moving the screw cap body 140 from the unlocked configuration where the screw cap body 140 is partially within the passage 112 of the spout 104 to the removed configuration where the screw cap body 140 is completely removed from the passage 112. In some embodiments, the aseptic plug 170 may be inserted into the passage 168 of the screw cap body 140, or alternatively, the aseptic plug 170 may be entirely removed from the assembly. With the screw cap body 140 removed from the passage 112, the desired fluid material may be introduced into the container through the opening 114 and through the passage 112 of the spout 104. When sufficient fluid has been moved into the container, the screw cap body 140 may be re-introduced into the passage 112 of the spout 104. The screw cap body 140 may be moved into the locked configuration, in which the locking element 160 engages with the annular lip 120 and the outer surface 154 of the screw cap body 140 contacts the inner surface 106 of the spout 104 to form an aseptic fluid-tight seal. The aseptic plug 170 may be inserted into the passage 168 of the screw cap body 140 to create an aseptic fluid tight seal between the aseptic plug 170 and the inner surface 155 of the screw cap body 140. Alternatively, if the aseptic plug 170 is already within the passage 168 and an aseptic fluid-tight seal is present, the filling and sealing process is complete.

A method of dispensing fluid from the container may include inserting a tool or a finger into the chamber 180 through the opening 182 of the aseptic plug 170. Force may then be applied to the ledge 184 from within the chamber 180 such that the aseptic plug 170 is dislodged from the passage 168 and removed from the screw cap body 140. This breaches the aseptic seal formed between the aseptic plug 170 and the screw cap body 140. Fluid can then be moved from within the container through the spout 104 and the screw cap body 140 out of the top opening 156. In some embodiments, the method may include a step of attaching a separate dispensing tool or connector to the assembly, for example to the external threads 146 on the top portion 144 of the screw cap body 140. When a sufficient amount of fluid has been dispensed from the container, the aseptic plug 170 may be reintroduced back into the passage 168 such that an aseptic seal is reformed. This prevents fluid from moving from the container out of the assembly. If a separate dispensing tool or connector was attached, the method may include the step of detaching the separate dispensing tool or connector before reintroducing the aseptic plug 170.

While the disclosure has been described in connection with the various embodiments of the various figures, it will be appreciated by those skilled in the art that changes could be made to the embodiments described above without departing from the broad inventive concept thereof. It is understood, therefore, that this disclosure is not limited to the particular embodiments disclosed, and it is intended to cover modifications within the spirit and scope of the present disclosure as defined by the claims.

Features of the disclosure that are described above in the context of separate embodiments may be provided in combination in a single embodiment. Conversely, various features of the disclosure that are described in the context of a single embodiment may also be provided separately or in any sub-combination. Finally, while an embodiment may be described as part of a series of steps or part of a more general structure, each said step may also be considered an independent embodiment in itself, combinable with other.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed:

1. A fluid transfer assembly for dispensing flowable material from a container, the fluid transfer assembly comprising:

a spout;

a screw cap body having an upper portion with a first inner diameter and a lower portion with a second inner diameter, wherein the first inner diameter is greater than the second inner diameter; wherein the upper portion and lower portion of the screw cap body are a unitary piece; and an aseptic plug that includes an upper portion and a lower portion, wherein the lower portion of the screw cap body receives the lower portion of the aseptic plug and the upper portion of the screw cap body receives the upper portion of the aseptic plug; and wherein the aseptic plug is configured to form an aseptic seal with the screw cap body.

2. The fluid transfer assembly of claim 1, wherein the upper portion of the aseptic plug includes a top surface that defines a plug chamber and has an opening therein that is offset from a center point of the top surface.

3. The fluid transfer assembly of claim 2, wherein the top surface defines a ledge over the plug chamber and the ledge is configured to receive a force in a first direction and a second direction opposite the first direction, wherein when force is applied in the first direction the aseptic plug is removed from the screw cap body, and when force is applied in the second direction, the aseptic plug is inserted into the screw cap body.

4. The fluid transfer assembly of claim 2, wherein the plug chamber is bowl shaped.

5. The fluid transfer assembly of claim 1, wherein the screw cap body is configured to be inserted into the spout such that the screw cap body is fixedly secured within the spout.

6. The fluid transfer assembly of claim 1, wherein the screw cap body includes a locking element configured to engage with a corresponding locking element on the spout.

7. The fluid transfer assembly of claim 1, wherein the aseptic plug includes a sealing element that engages an inner surface of the screw cap body to form the aseptic seal with the screw cap body.

* * * * *